US005365321A

United States Patent [19]

Koshimizu et al.

[11] Patent Number: 5,365,321

[45] Date of Patent: Nov. 15, 1994

[54] ENDLESS BELT DRIVING DEVICE WITH AUTOMATIC BELT DISPLACEMENT CORRECTION

[75] Inventors: Masato Koshimizu, Yokohama; Yuji Yamanaka, Kawasaki, both of Japan

[73] Assignee: Canon Kabushiki Kaisha, Tokyo, Japan

[21] Appl. No.: 67,854

[22] Filed: May 27, 1993

[30] Foreign Application Priority Data

Jun. 5, 1992 [JP] Japan ..... 145871

[51] Int. Cl.[5] ..... G03G 15/20

[52] U.S. Cl. ..... 355/285; 355/212; 198/806; 226/23

[58] Field of Search ..... 355/285, 212; 198/806; 226/21, 23

[56] References Cited

U.S. PATENT DOCUMENTS

| | | | |
|---|---|---|---|
| 2,655,252 | 10/1953 | Spurgeon | 198/806 |
| 2,725,757 | 12/1955 | Murphy | 198/806 X |
| 3,540,571 | 11/1970 | Morse et al. | 198/806 |
| 3,698,540 | 10/1972 | Jordan | 198/806 |
| 3,715,027 | 2/1973 | Fujimoto | 198/806 |
| 3,726,588 | 4/1973 | Moser | 198/806 X |
| 3,818,391 | 6/1974 | Jordon et al. | 198/806 X |
| 3,993,186 | 11/1976 | Sokolowski | 198/806 |
| 4,027,966 | 6/1977 | Jordan | 198/806 X |
| 4,170,175 | 10/1979 | Conlon | 198/806 X |
| 4,174,171 | 11/1979 | Hamaker et al. | 198/806 X |
| 4,286,706 | 9/1983 | Castelli et al. | 198/806 |
| 4,367,031 | 1/1983 | Hamaker | 198/806 X |
| 4,397,538 | 8/1983 | Castelli et al. | 198/806 X |
| 4,462,676 | 7/1984 | Shimura et al. | 198/806 X |
| 4,506,782 | 3/1985 | Jeanneret et al. | 198/806 |
| 5,027,160 | 6/1991 | Okada et al. | 355/282 |
| 5,043,763 | 8/1991 | Koh et al. | 355/206 |
| 5,149,941 | 9/1992 | Hirabayashi et al. | 219/216 |

FOREIGN PATENT DOCUMENTS

| | | | |
|---|---|---|---|
| 962164 | 7/1964 | United Kingdom | 198/806 |

*Primary Examiner*—R. L. Moses

*Attorney, Agent, or Firm*—Fitzpatrick, Cella, Harper & Scinto

[57] ABSTRACT

An endless belt driving device comprises an endless belt, a driving roller for driving the endless belt, a guide member for guiding the movement of the endless belt, and a supporting plate by which the guide member is supported so as to be rotatable about an axis perpendicular to the length of the guide member. When the endless belt is laterally displaced along the guide member, a load resulting from the force of displacement causes the guide member to turn. Consequently, a force oriented opposite to the direction of displacement acts on the endless belt.

17 Claims, 18 Drawing Sheets

ENDLESS BELT DRIVING DEVICE WITH AUTOMATIC BELT DISPLACEMENT CORRECTION

BACKGROUND OF THE INVENTION

1. Field of the Invention

The present invention relates to a drive for driving an endless belt and to an image heating apparatus for heating an image on a recording material with the heat of a heater through the endless belt.

2. Description of the Related Art

A heat roller fusing system has widely been adopted as a fusing mechanism for heating and fusing a toner image on a recording material, wherein a heating roller maintained at a specified temperature, and a pressurizing roller having an elastic layer and pressing the heating roller are used to hold and transport, and heat a recording material on which a non-fused toner image is formed.

In recent years, a film heating system proposed in U.S. Pat. Nos. 5,149,941 and 5,043,763 has been recognized as a superb heating system substitute for the heat roller system and put to practical use.

In the film heating system, the use of endless belt-type film is preferred because it obviates the need for a rewind process. However, measures must be taken against displacement of the endless film.

In U.S. Pat. No. 5,027,160, a position of an endless belt in lateral shifting direction is detected, a solenoid is used to displace the position of one end of a follower roller, and then the endless belt is reciprocated within a specified range.

FIGS. 18 to 20 show an example of a heating fusing mechanism that changes the position of one end of a follower roller by turning on or off a solenoid.

FIG. 18 shows a state in which a bearing 135 at the back of a follower roller 124 is pushed down. FIG. 19 shows a state in which the bearing 135 of the follower roller 125 is pushed up by spring 137.

As shown in FIGS. 18 and 19, the bearing 135 of the follower roller 124, which is a pair of a driving roller 125, is supported by a side plate 146 so as to be slidable vertically. One end of the follower roller 124 is supported by the bearing 135 so as to be rotatable, and the other end thereof is supported by a bearing (not shown) formed on a side plate 147 so as to be rotatable.

A locking member 136 mounted on the side plate 146 supports one end of a spring 137 for pushing up the bearing 135. The other end of the spring 137 pushes the bottom of the bearing 135. A spring clutch 138 is made up of an input hub (not shown), a coil spring (not shown) having a control claw (not shown), a control collar 140*a* formed to hold the control claw, and an output hub 141. When as shown in FIGS. 18 and 19, an engagement claw 140*b* or 140*c* engages with a lever claw 144 and the control collar 140*a* is at a halt, the power of the input hub is not transmitted to the output hub 141. When the lever claw 144 separates from the engagement claw 140*b* or 140*c*, the control collar 140*a* becomes rotatable. The power of the input hub is transmitted to the output hub 141. A torque is always transmitted to the input hub via a gear (not shown) in an arrow-B direction in FIG. 18.

A cam 139 whose radius varies depending on an angle of rotation is fixed to the output hub 141 so as to rotate as part of the output hub 141. When the engagement claw 140*b* engages with the lever claw 144 as shown in FIG. 18, the lower radius of the cam 139 becomes maximum. When the engagement claw 140*c* engages with the lever claw 144 as shown in FIG. 19, the lower radius of the cam 139 becomes minimum. The radii of the cam 139 at other positions are determined to provide smooth transition between the maximum and minimum.

When the engagement claw 140*b* engages with the lever claw 144, the maximum-radius part of the cam 139 pushes down the bearing 139. When the engagement claw 140*c* engages with the lever claw 144, the bearing 135 is pushed up by the spring 137.

A lever 143 is supported by a spindle 142 implanted in the side plate 146 so as to be rotatable. The lever claw 144 is formed on the other end of the lever 143 which is coupled with an operating beam of a solenoid 145. The solenoid 145 is turned on for a specified period of time according to the signals from sensors 148 and 149 which will be described later.

The sensors 148 and 149 detects that a heat-resistant endless belt 123 has moved behind or ahead of a specified position. The output signals of the sensors 148 and 149 are sent to a microcomputer, whereby the solenoid 145 is turned on or off according to a specified sequence.

In FIGS. 18 and 19, 121 denotes a heat generator and 122 denotes a pressurizing roller. Reference numerals 132 and 134 denote guide plates.

FIG. 20 show the positional relationship between the follower roller 124 and driving roller 125, viewing the follower roller 124 and driving roller 125 from a paper feed section. As described previously, when the minimum-radius part of the cam 139 abuts the bearing 135 as shown in FIG. 19, the spring 137 pushes up the end of the follower roller 124. The follower roller 124 rises rightward as shown in FIG. 20. At this time, the heat-resistant endless belt 123 moves rightward (backward) in FIG. 18. In contrast, as described previously, when the cam 139 pushes down the bearing 135, the heat-resistant endless belt 123 moves leftward (forward).

The aforesaid mechanism requires sensors for detecting the position of an endless belt and a displacement member for displacing a follower roller, thus becoming large in size. Furthermore, since the endless belt is reciprocated forcibly all the time, if thin film is employed, the durability of the thin film deteriorates.

SUMMARY OF THE INVENTION

An object of the present invention is to provide an endless belt driving device capable of preventing the displacement of an endless belt without sensing the position of the endless belt.

Another object of the present invention is to provide an endless belt driving device capable of converting a force of displacement of an endless belt into a reversely-oriented force of displacement.

Yet another object of the present invention is to provide an endless belt driving device comprising an endless belt, a driving means for driving the endless belt, a guide member, having a longitudinal axis, for guiding the movement of the endless belt, and a supporting means for rotatably supporting the guide member so that the guide member is rotatable about an axis extending in a direction perpendicular to the longitudinal axis of the guide member in response to lateral displacement of the belt along the guide member.

Still another object of the present invention is to provide an image heating apparatus including an endless belt, a driving means for driving the endless belt, a guide member, having a longitudinal axis, for guiding the movement of the endless belt, a heater for heating an image on a recording material through the endless belt, and a supporting means for rotatably supporting the guide member so that the guide member is rotatable about an axis extending through the mid-point of the guide member in a direction perpendicular to the longitudinal axis of the guide member.

An even further object of the present invention is to provide an endless belt driving device including an endless be;It, a driving means for driving the endless belt, a guide member, which includes a roller portion that is rotatable about a longitudinal axis of the guide member, and a portion which is not rotatable about the longitudinal axis, disposed along the length of the guide member for guiding movement of the endless belt, and a supporting means for rotatably supporting the guide member, wherein the supporting means includes a bias means for biasing the guide member so as to apply a force to the guide member which tends to produce rotation of the guide member about an axis extending in a first direction perpendicular to the length of the guide member and means for producing rotation of the guide member in a second direction, opposite to the first direction, in response to contact between the endless belt and the roller portion of the guide member.

One particular embodiment of the present invent/on is an endless belt driving device comprising an endless belt, a driving means for driving the endless belt, a guide member for guiding the movement of the endless belt, and a supporting means by which the guide member is supported so as to be rotatable with the substantial center in the longitudinal direction of the guide member as a center.

Other objects of the present invention will be apparent from the description below.

DESCRIPTION OF THE PREFERRED EMBODIMENTS

To begin with, the principle of a self-aligning capability employed in embodiments of the present invention will be described in con,junction with FIG. 17.

Figure 17:
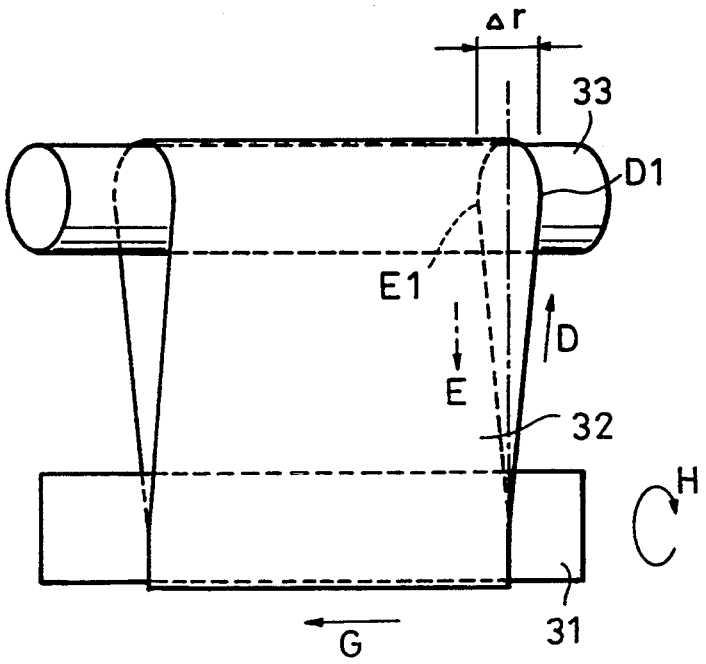
FIG. 17 is a diagram for explaining the self-aligning capability of fusing film employed in a fusing mechanism of the present invention.
Figure 18:
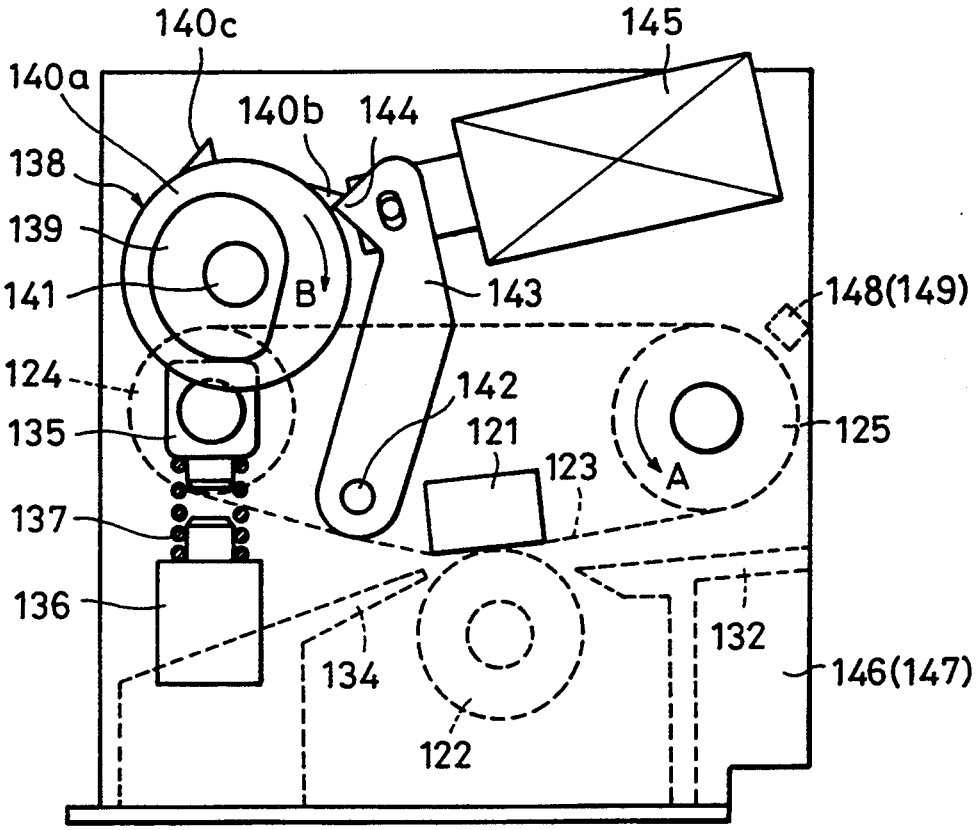
FIG. 18 is a diagram for explaining the edge control for fusing film in a conventional fusing mechanism.
Figure 19:
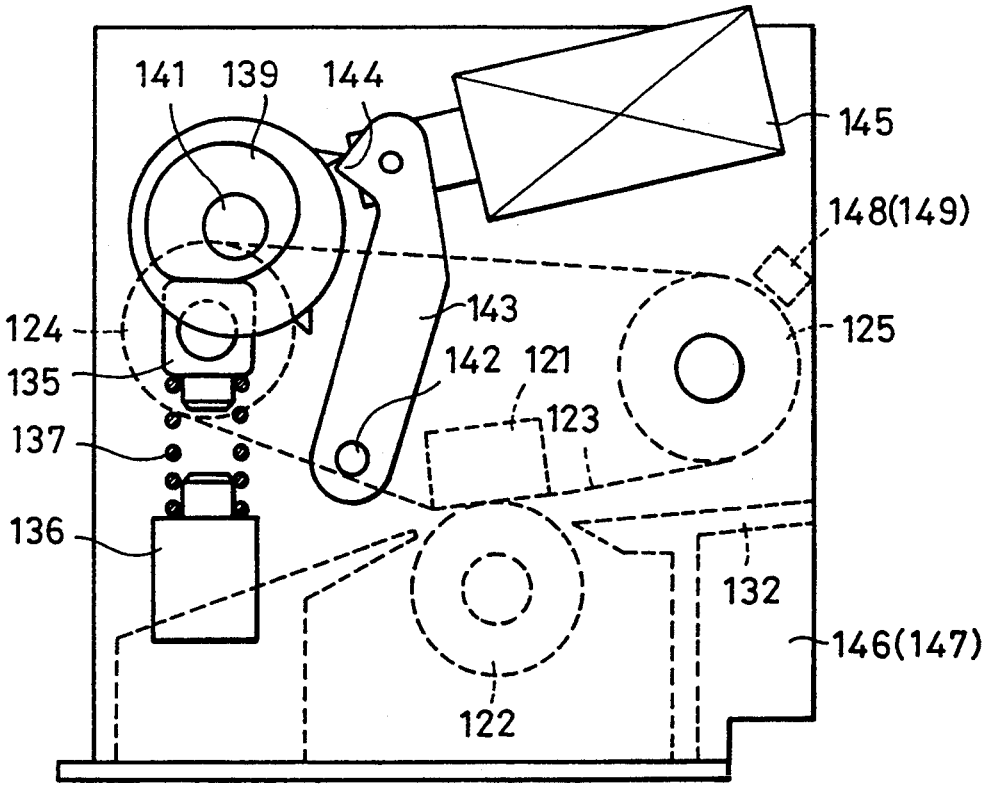
FIG. 19 is a diagram for explaining the edge control for fusing film in a conventional fusing mechanism.
Figure 20:
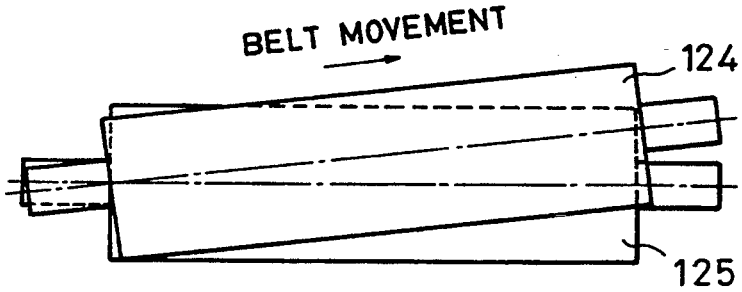
FIG. 20 is a diagram for explaining the edge control for fusing film in a conventional fusing mechanism.

In FIG. 17, 31 and 33 denote a pair of rollers whose axes are not in parallel with each other. One end (left end in FIG. 17) of the roller 33 is lying forward from the surface of the drawing, while the other end (right end in FIG. 17) thereof is lying beyond the surface of the drawing. The axis of the roller 31 is in parallel with the surface of the drawing. 32 denotes an endless belt wound about the rollers 31 and 33. In response to the rotation of the roller 33 in the direction indicated by arrow H, the endless belt 32 rotates or runs in the direction of arrows D and E. The upper part of the endless belt comes into contact with the outer circumferential surface of the roller 33 at a point D1, and departs from the outer circumferential surface of the roller 33 at a point E1 that is distanced from the point D1 by $\Delta r$. That is to say, when one of the rollers tilts with respect to the other one, the endless belt moves in an arrow-G direction in increments of $\Delta r$ along the axis of a roller (along the width of the belt) while running between the rollers. The belt 32 moves from the descending end (right end) of the roller 33 toward the ascending end (left end).

An image heating apparatus using an endless belt driving device of an embodiment of the present invention will be described.

FIGS. 1 to 4 show the first embodiment of the present invention. Reference numeral 7 denotes an endless belt type fusing film. The endless belt type fusing film 7 is wound about a left-hand driving roller 8, a semi-cylindrical tension guide 9A, and a low heat-capacity linear heater 1 that is located below and between the roller 8 and tension guide 9A and serves as a heater, and runs in an arrow-A direction.

The tension guide 9A is fixed to sliding plates 20. Each of the sliding plates 20 has an elongated hole 20*a* into which each of pins 21*a* of a seesaw 21 is fitted, and moves perpendicularly to the surface of the fusing film 7. A tension spring 22 is placed between one of the sliding plates 20 and the seesaw 21. When the tension guide 9A is pulled right obliquely upward with a specified force, a specified tension is applied to the fusing film 7.

The seesaw 21 has an axis rod 23 in the center thereof. The axis rod 23 is freely rotatable due to a bearing 24. Specifically, the tension guide 9A can turn or rotate in an arrow-a direction, about an axis which is perpendicular to the longitudinal axis of the tension guide 9A, with the axis rod 23 as a center or, in other words, can tilt to twist the film 7 with a specified tension applied to the film 7.

The outer circumferential surface of the center 9*a* of the tension guide 9A in this embodiment (that is, the portion of the tension guide 9A that is brought into contact with the fusing film 7 when the tension guide 9A is held level) is made of a material having a low friction factor. The outer circumferential surfaces of ends 9*b* outside the center 9*a* are made of a material having a high friction factor. According to this structure, as described later, even when the fusing film 7 is deviated laterally from the normal running path, the fact is detected with a higher sensitivity and the fusing film 7 shows an excellent self-aligning capability.

The fusing film 7 is driven to rotate clockwise at a specified peripheral velocity. This a peripheral velocity is identical to a velocity of transporting a recording material P, that is transported from an image forming section which is not shown, carrying a non- fused toner image Ta on the top thereof. The fusing film rotates along with the clockwise rotation of the driving roller 8 without shrinking, becoming tortuous, and lagging behind.

Reference numeral 10 denotes a pressurizing roller having an elastic layer 12 made of a rubber capable of being parted effortlessly; such as, silicon rubber, which serves as a pressurizing member. The pressurizing roller 10 is pressed toward the bottom of the heater 1 using a pressing means, which is not shown, with a total pressure ranging, for example, from 4 to 7 kg with the downstream portion of the endless belt type fusing film 7 between them. The pressurizing roller 10 rotates counterclockwise or in the forward direction of transporting the recording material P with an axis 11 as a center.

The heater 1 is a low heat-capacity linear heater whose longitudinal side is directed toward crossing the direction of surface movement of the film 7 (cross direction of the film), comprising a heater substrate 3, a conducting heating resistor (heating element) 4, and a thermometric element The heater 1 is mounted in a heater support 2, and thus locked in and held by the heater support 2.

The heater support 2 possesses a heat insulation ability, a high heat resistance, and a rigidity, enabling the insulation of and the support for the heater 1 relative to the other components, which are not shown, of the fusing mechanism. The heater support 2 can be made of, for example, polyphenylene sulfide, polyamidimide, polyimide, polyether ketone, high heat-resistant resins including liquid polymer, or composite materials of these resins and ceramic, metal, or glass.

The heater substrate 3 is a member possessing a heat resistance, an insulation ability, and a low heat capacity, for example, an aluminum substrate of 1.0 mm thickness, 16 mm width, and 340 mm length.

The heating element 4 is made by coating the substantial center of the bottom (surface in contact with the film 7) of the substrate 3 longitudinally with, for example, silver palladium, $Ta_2N$, or other electrically-resistant material of about 10 micrometers thick and 1 to 3 millimeters wide using silk-screen printing, and further providing it with a coat of heat-resistant glass 6 about 10 micrometers thick as a surface protecting layer.

The thermometric element 5 is a thermometric resistor having a low heat capacity, which is made by coating the substantial center of the top (surface on the opposite side of the surface having the heating element 4) of the substrate 3 witch platinum by silk-screen printing. Alternatively, a thermistor having a low heat capacity may be placed on the substrate 3 as the thermometric element.

In the heater 1 of this embodiment, the linear or band-like heating element 4 is put into conduction through the ends in the longitudinal direction thereof, and thus heated substantially all over the length. Conduction is achieved with 100 VAC. A conduction control circuit, which is not shown, including a triac is used to control a phase angle for conduction according to a temperature detected by the thermometric element 5, thus controlling electric power.

A monolayer or a complex-layer film possessing a heat resistance, a parting ability, and a durability and having a total thickness of at most 100 micrometers, or preferably, at most 40 micrometers can be employed as the fusing film 7.

Next, the operation of an image forming apparatus having a fusing mechanism of this embodiment will be described.

In response to an image formation start signal, an image forming apparatus, which is not shown, operates to form an image. The image is transported to the fusing mechanism. The recording material sheet P carrying a non-fused toner image Ta on the top thereof is routed by the guide 18 to enter into a gap between the fusing film 7 and pressurizing roller 10 in a pressing section (fusing nip) in which the heater 1 and pressurizing toiler 10 are pressed toward each other. The surface of the recording material sheet P having the non-fused toner image then comes into close contact with the bottom of the fusing film 7 that is rotating in the same direction as the recording material sheet P at the same speed as the speed of transporting the recording material sheet P. Thus, the recording material sheet P overlaps the fusing film 7, is subjected to a pressure, and still passes through the pressing section, in which the heater 1 and pressurizing roller 10 are pressed toward each other, without causing surface deviation, shrinkage or displacement.

The heater 1 is put into conduction and heated according to the specified timing in response to an image formation start signal. The toner image Ta is therefore heated in the pressing section to become a softened and melted image Tb.

The fusing film 7 changes running direction by a sharp angle (bending angle $\theta$ is substantially 45°) at a large-curvature edge S of the heater support 2. The sheet P, which has passed the pressing section in a state of overlapping the fusing film 7, is curved by the edge S and separated from the fusing film 7, and ejected into a discharge tray. By the time the sheet P is ejected, the toner has been cooled and solidified sufficiently, so as to fuse perfectly to the sheet P (to provide a toner image Tc).

In this embodiment, the :heating element 4 and substrate 3 in the heater 1, which have small heat capacities, are insulated and supported by the support 2. The surface temperature of the heater 1 rises to a high temperature, which is higher than a melting point of toner (or a temperature at which toner can be fused to the sheet P), for a short period of time in the pressing section. The temperature of the heater 1 therefore need not be raised in advance (so-called standby warming-up), which realizes energy saving and prevents a temperature rise inside the apparatus.

Figure 1:
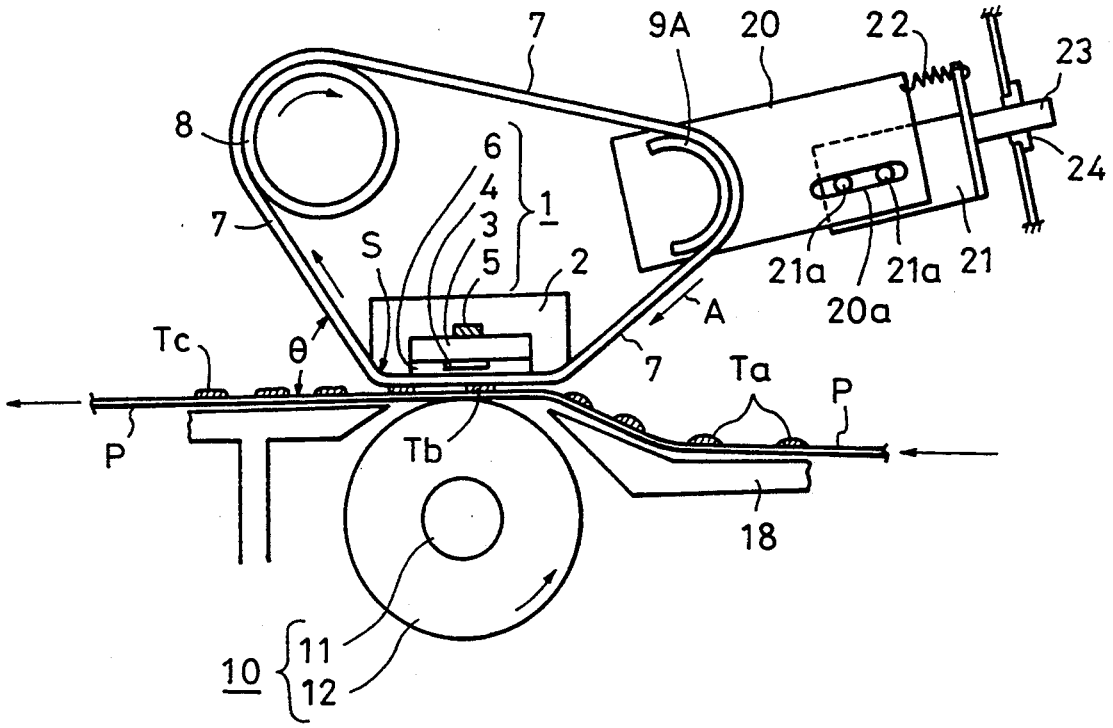
FIG. 1 is a schematic side view of a fusing mechanism in a first embodiment of the present invention.
Figure 2:
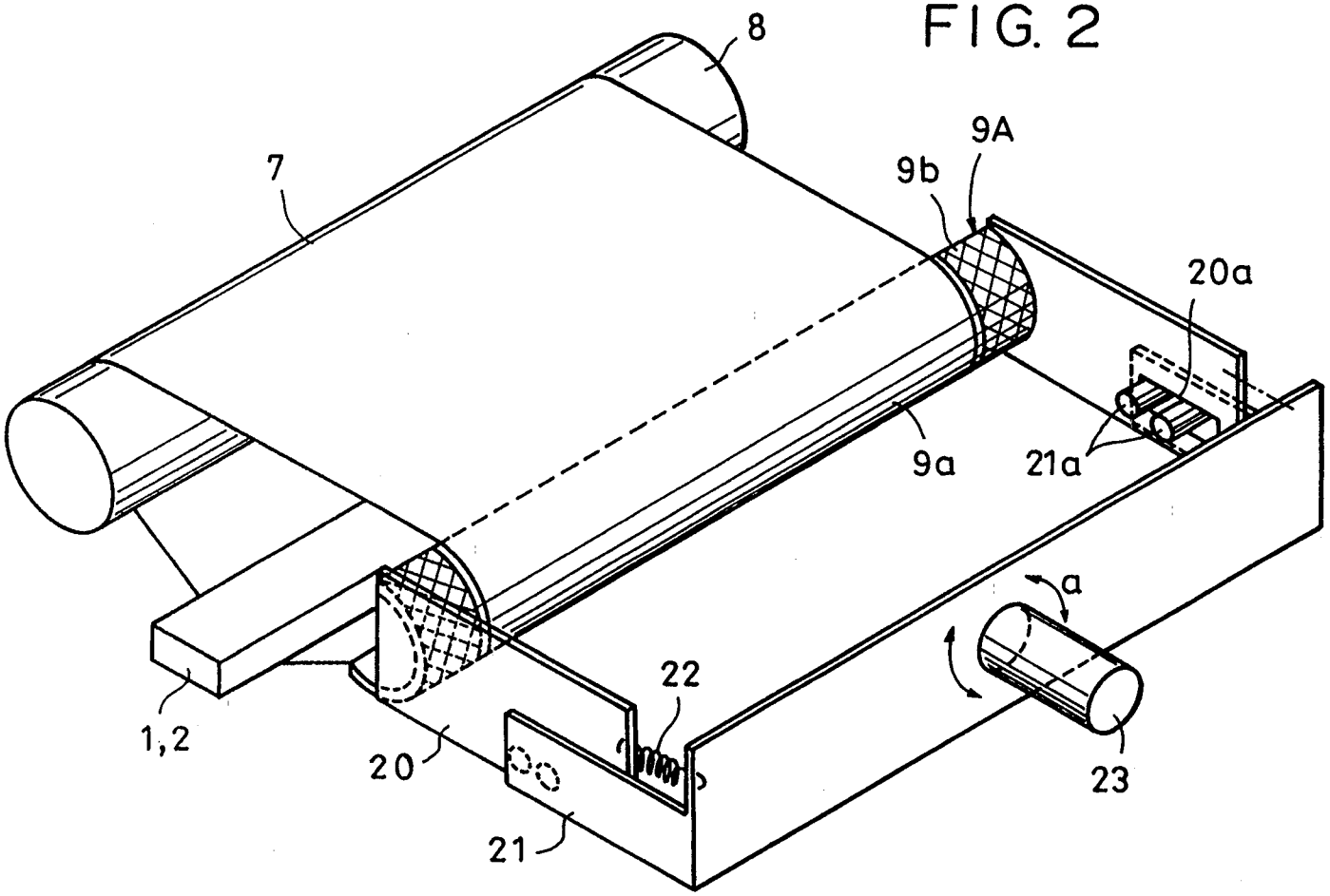
FIG. 2 is a perspective view showing a fusing film drive in the fusing mechanism of FIG. 1.
Figure 3A:
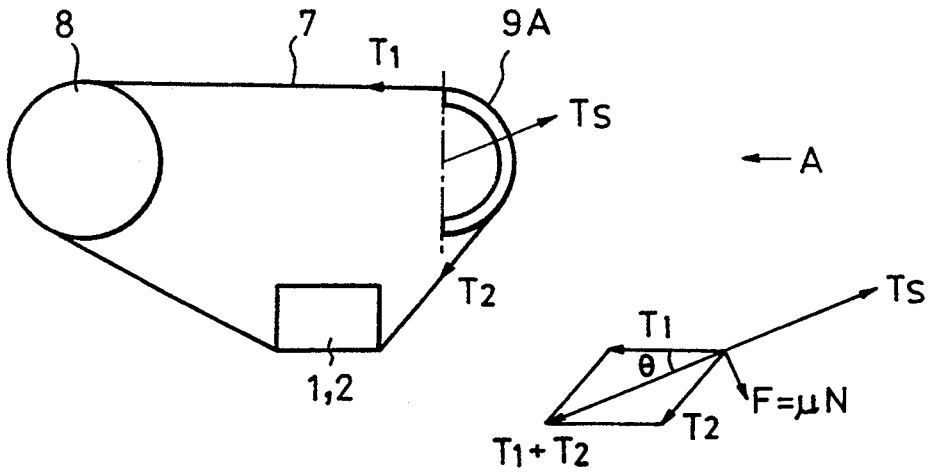
FIG. 3*a* shows forces applied to the fusing film in the fusing film drive.
Figure 3B:
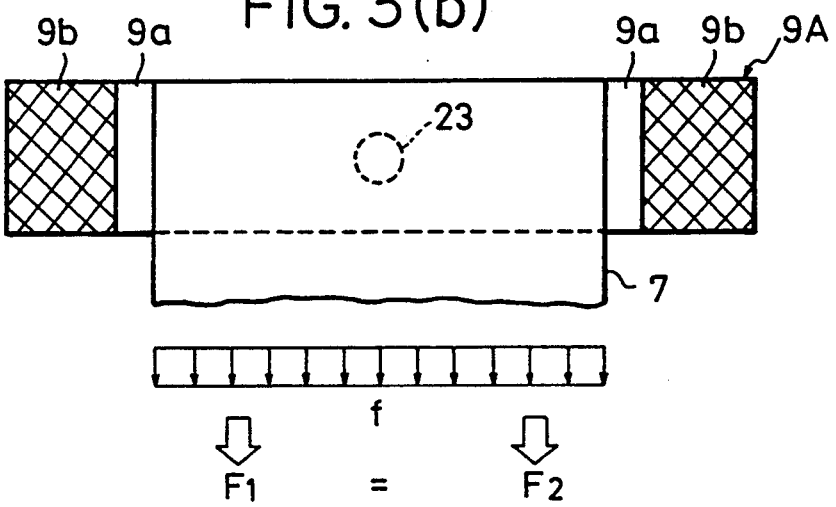
FIGS. 3*b* and 3*c* show the position of the fusing film on a tension guide of the fusing film drive and the load to the tension guide.
Figure 3C:
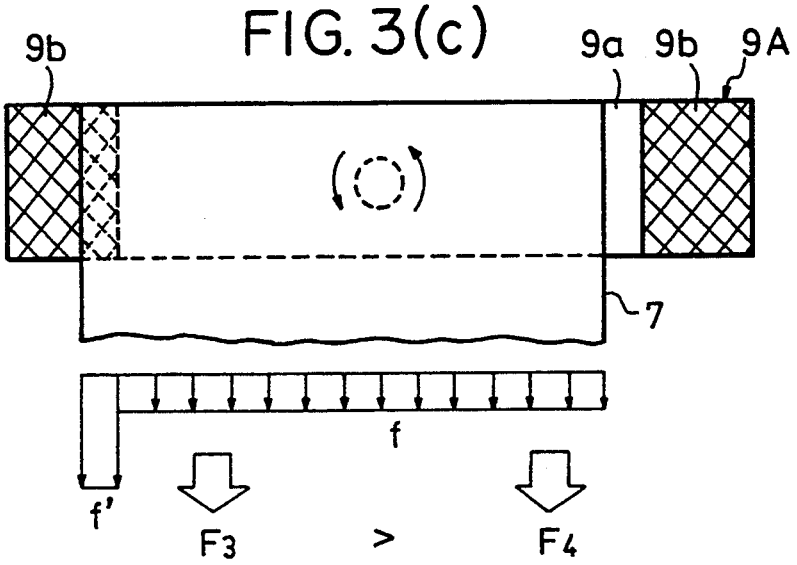
Figure 4A:
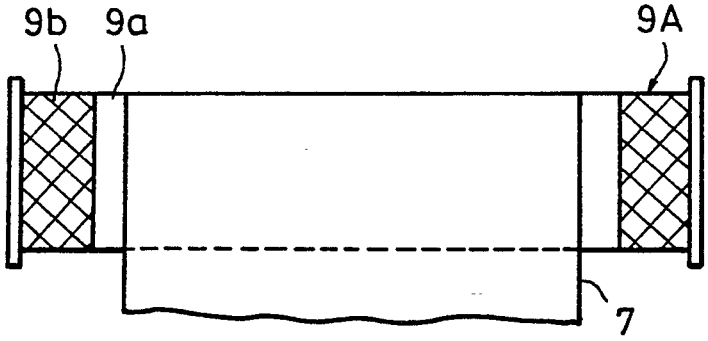
FIGS. 4(*a*) to 4(*c*) are diagrams for explaining the shift in the running position of the fusing film in the fusing film drive of FIG. 2, and the self-aligning capability of the fusing film.
Figure 4B:
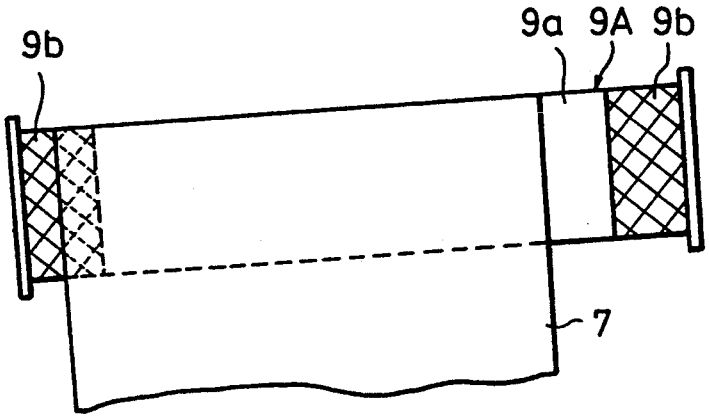
Figure 4C:
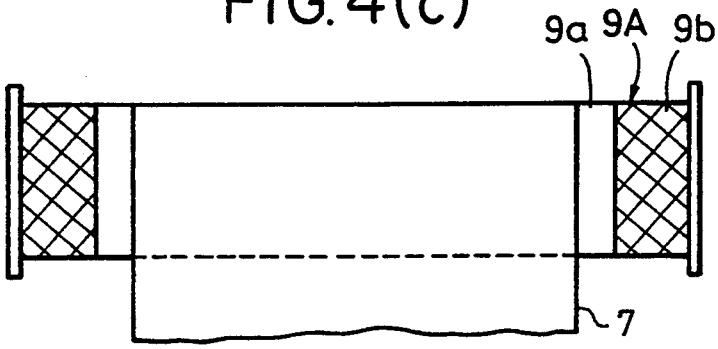

Next, referring to FIGS. 3 and 4, the self-aligning capability of the fusing film will be described. As shown in FIG. 3*a*, a force applied to the tension guide 9A includes Ts (force brought by the tension spring 22), and $T_1$ and $T_2$ (fusing film tension), and $\mu N$ (a frictional force between the tension guide and film). The sum of $T_1+T_2$ is equal to Ts and works in the opposite direction of Ts. $T_1+T_2$ and Ts therefore cancel out mutually. Consequently, the force applied to the tension guide 9A is the frictional force $\mu N=F$ alone. As shown in FIGS. 3*b* and 4*a*, when the fusing film 7 runs through the center of the tension guide 9A, a uniform load f is imposed on the tension guide 9A. This is because the fusing film 7 is laterally symmetrical with respect to the axis rod 23, and $F_1$ equals to $F_2$. The seesaw 21 therefore does not tilt, and the tension guide 9A is kept parallel with the driving roller 8 and heater 1. If the fusing film 7 shifts to the left for some reasons as shown in FIGS. 3*c* and 4*b*, the fusing film 7 intrudes into the end 9*b* (in which the friction factor is higher than in the center 9*a*) of the tension guide 9A. The total load on the left of the axis rod 23 comes to $F_3$, and the total load on the right thereof comes to $F_4$, wherein $F_3$ is larger than $F_4$. As a result, the seesaw 21 turns counterclockwise with the axis 23 as a center, and the tension guide 9A tilts leftward about an axis extending in a direction perpendicular to the lateral dimension of the tension guide 9A as shown in FIG. 4*b*. The fusing film 7 is then twisted as shown in FIG. 17. Eventually, a force attempting to return the film to the original state works on the fusing film 7 due to the principle described in conjunction with FIG. 17. The fusing film 7 returns gradually to the vicinity of the center in the axial direction of the tension guide 9. When the center in the cross direction of the fusing film 7 returns to align with the axis rod 23, the seesaw 21 is leveled again and the tension guide 9A is also leveled again.

In this embodiment, the outer circumferential surfaces of the ends 9*b* of the tension guide 9A have a larger friction factor than that of the center 9*b* thereof. The unit load f' at the end 9*b* on which the fusing film 7 rides therefore becomes larger than f. This means that a larger force can be exerted to return the fusing film 7 to the original position than that when the outer circumferential surface of the entire tension guide 9A has the same friction factor.

Figure 5:
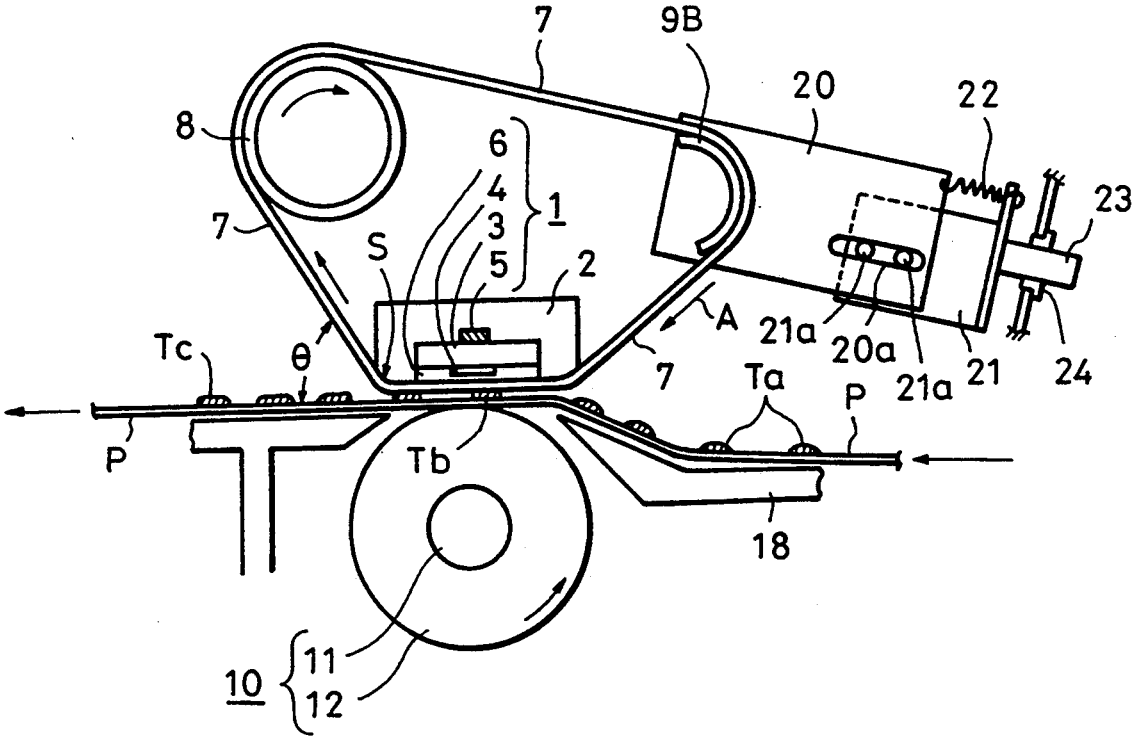
FIG. 5 is a schematic side view of a fusing mechanism in a second embodiment of the present invention.
Figure 6:
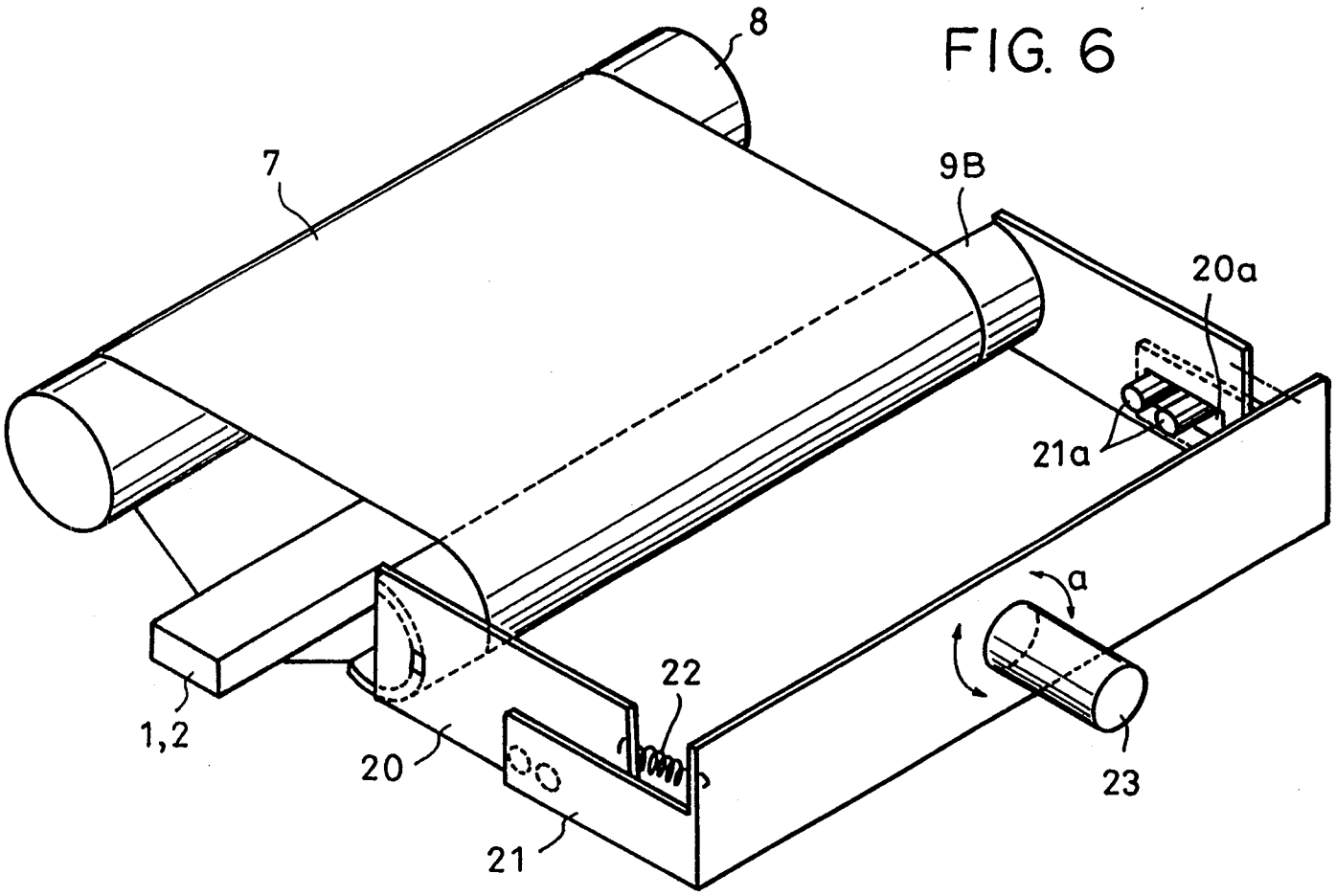
FIG. 6 is a perspective view showing an appearance of a fusing film drive in the fusing mechanism of FIG. 5.
Figure 7A:
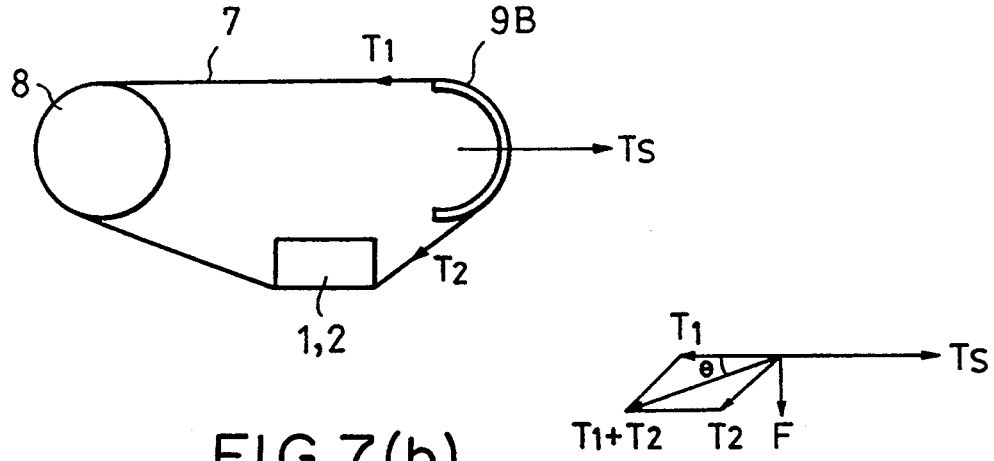
FIG. 7*a* shows a force applied to fusing film in the fusing film drive.
Figure 7B:
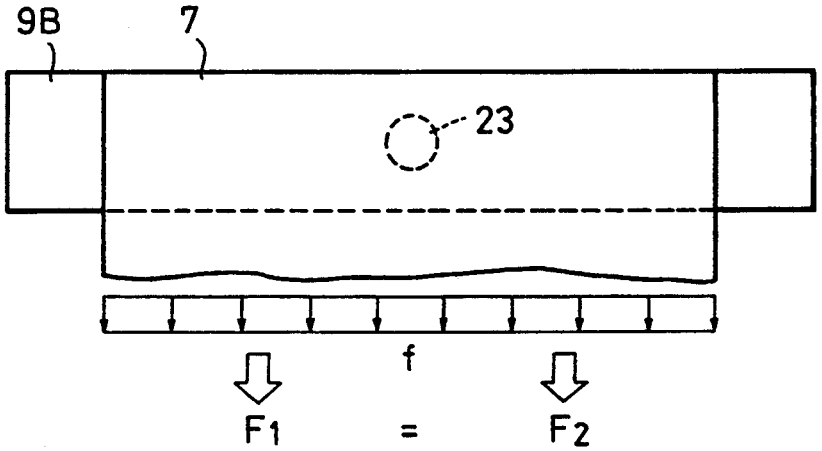
FIGS. 7*b* and 7*c* show the position of the fusing film on a tension guide in the fusing film drive unit, and the load to the tension guide.

FIGS. 5 to 7 show the structure and function of a fusing mechanism in the second embodiment of the present invention. In the drawings, components bearing the same numerals as those in FIGS. 1 to 4 are identical to those in the first embodiment. The description therefore will, accordingly, be omitted.

Figure 7C:
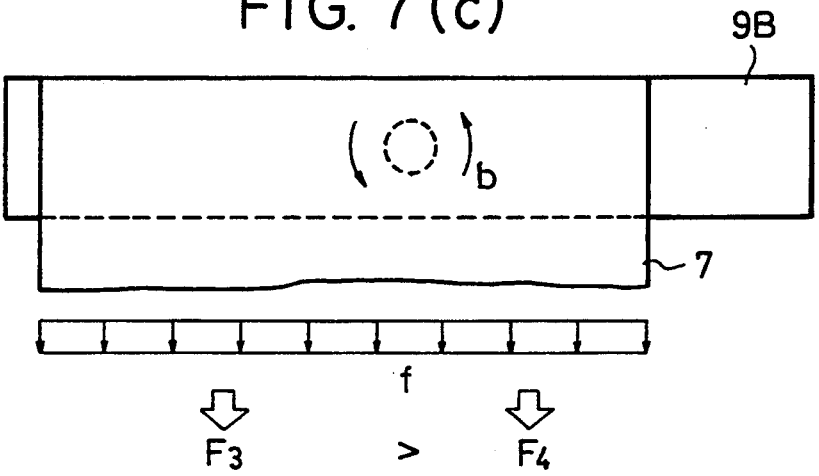

In the second embodiment, the outer circumferential surface of a tension guide 9B has the same friction factor. When the fusing film 7 runs being deviated leftward from the axis rod 23 as shown in FIG. 7*c*, the total load on the left of the axis rod 23, $F_3$, becomes, as described previously, larger than the total load on the right thereof, $F_4$. The seesaw 21 then turns leftward with the axis rod 23 as a center, and the tension guide 9B tilts leftward about an axis extending in a direction perpendicular to the tension guide 9A. As a result, the fusing film 7 is twisted in the cross direction thereof. Based on the principle described in conjunction with FIG. 17, the film 7 begins moving from the left descending end of the tension guide 9B toward the right ascending end thereof. When the film returns to the original position shown in FIG. 7*b*, the seesaw 21 and tension guide 9B are leveled again. Consequently, a phenomenon that the fusing film 7 slides in the cross direction thereof ceases. For reliable autonomous alignment, it is, however, preferred that the ends of the tension guide 9B have a larger friction factor than the center thereof, as in the previous embodiment.

FIG. 8 shows a tension guide alone in the third embodiment of a fusing mechanism of the present invention. Ends 9*d* of a tension guide 9C in this embodiment are realized as divergent tapered sections whose diameters increase in a direction away from the middle of the tension guide toward outside, while a center portion 9*c* thereof is realized as a cylindrical section whose outer diameter is constant. When the tension guide 9C having the above shape is employed, and the fusing film 7 is in symmetrical lateral contact with the tension guide 9C with respect to the axis rod 23 as a center as indicated with a solid line in FIG. 8*a*, the load distribution on the tension guide 9C becomes symmetrical with respect to the axis rod 23 as a center as shown in FIG. 8*b*. A moment for swinging the tension guide 9C about the axis rod 23 does not occur. When the fusing film 7 shifts leftward to the position indicated with a dot-dash line in FIG. 8*a*, the load distribution becomes as shown in FIG. 8*c*. The total load on the left of the axis rod 23, $F_3$, becomes larger than the total load on the right thereof, $F_4$. The seesaw 21 and tension guide 9C turns leftward with the axis rod 23 as a center, and then the fusing film 7 is twisted. As a result, a force for moving the fusing film from the descending end of the tension guide 9C toward the ascending end thereof acts on the fusing film 7 due to the principle described previously in conjunction with FIG. 17. The fusing film 7 returns to the original position over the tension guide 9C. This causes the seesaw 21 and tension guide 9C to level gradually. When the center in the cross direction of the fusing film 7 aligns with the axis rod 23, the tension guide 9C and seesaw 21 are leveled. The movement of the fusing film 7 in the cross direction thereof stops autonomously.

In this embodiment, the ends 9*d* of the tension guide 9C are divergent tapered sections. Therefore, when the fusing film 7 rides on one of the ends 9*d*, a quite asymmetrical load distribution is attained on the tension guide 9C with respect to the axis rod 23. This means that a larger force is exerted to return the fusing film 7 to the original position.

Figure 8A:
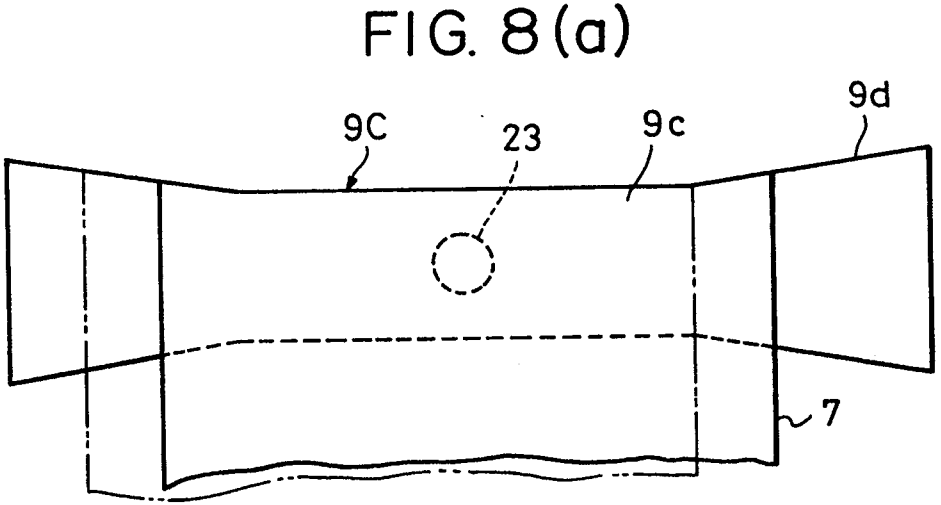
FIG. 8*a* shows the shape of a tension guide employed for a fusing mechanism in a third embodiment of the present invention.
Figure 8B:
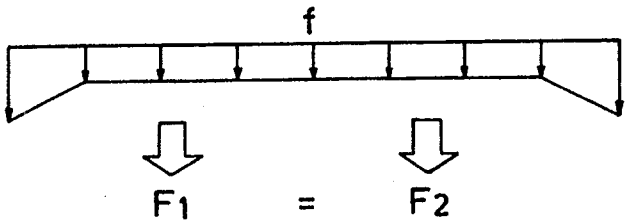
FIGS. 8*b* and 8*c* show the relationship between the position of the fusing film on the tension guide and the load to the tension guide.
Figure 8C:
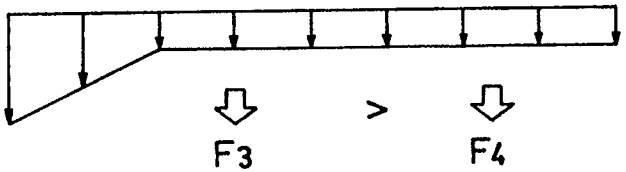
Figure 8D:
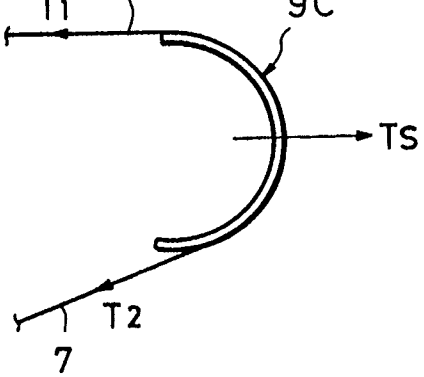
FIGS. 8*d* and 8*e* show the relationship among forces applied to the tension guide.
Figure 8E:
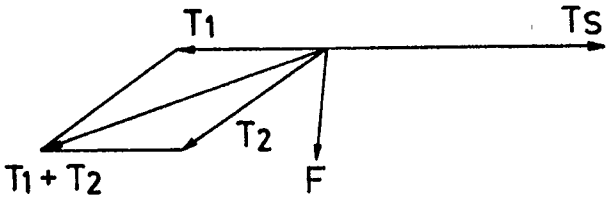
Figure 9:
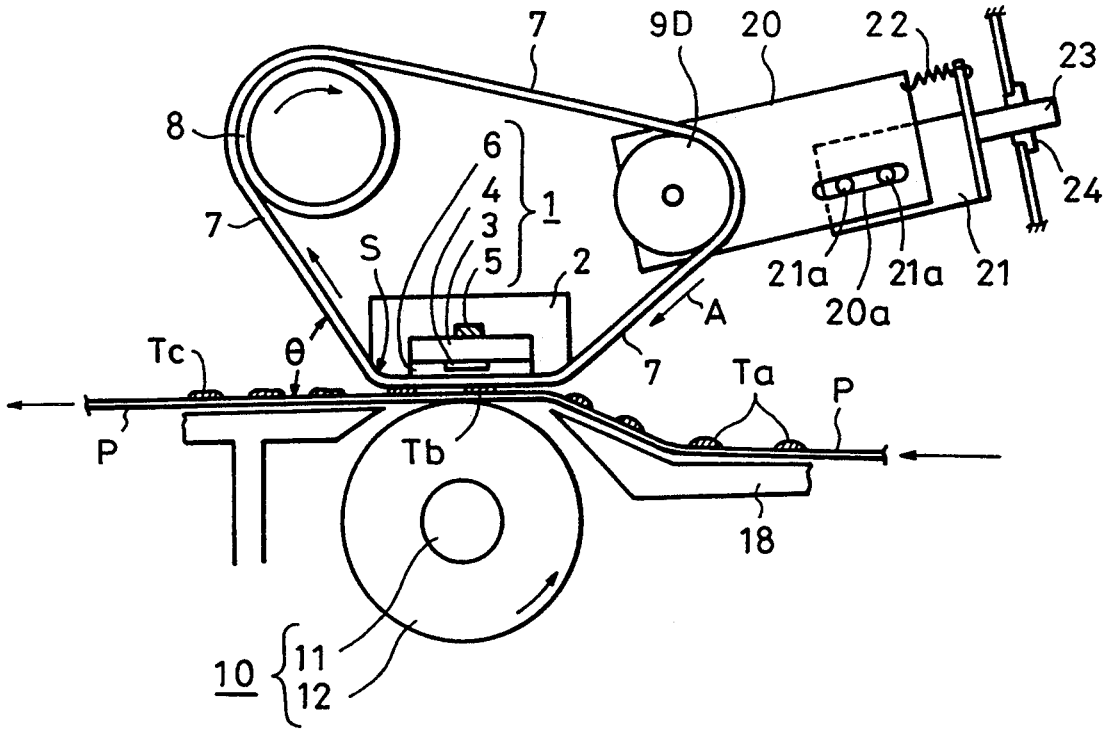
FIG. 9 is a schematic side view of a fusing mechanism in a fourth embodiment of the present invention.
Figure 10:
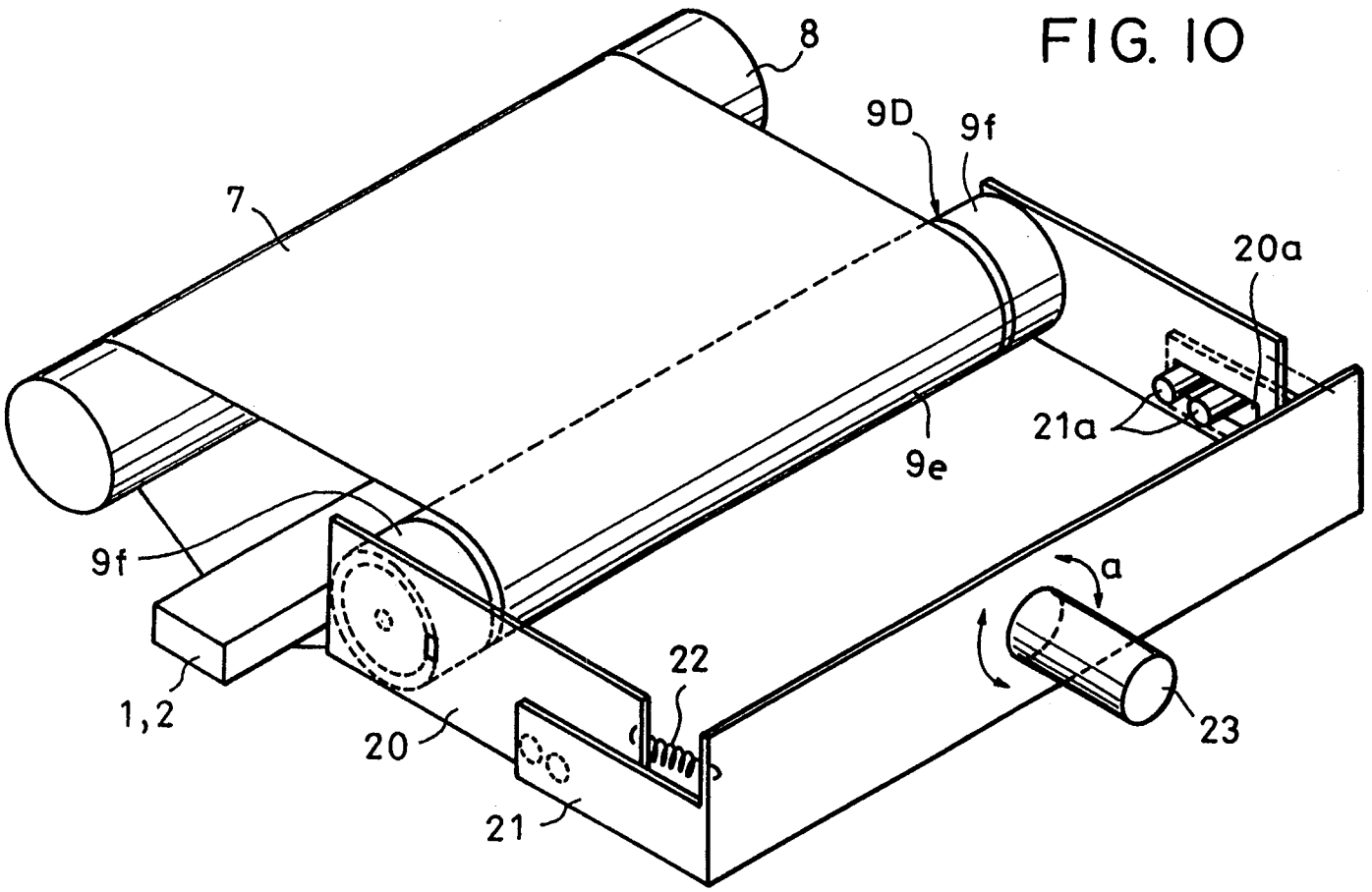
FIG. 10 is a perspective view showing an appearance of a fusing film drive in the fusing mechanism of FIG. 9.

FIG. 8*d* shows forces applied to the tension guide 9C. FIG. 8*e* shows the vectors of the forces.

FIGS. 9 to 12 show the structure and function of a fusing mechanism in the fourth embodiment of the present invention. In FIGS. 9 to 12, components bearing the same numerals as those in the first embodiment will not be described.

Figure 11A:
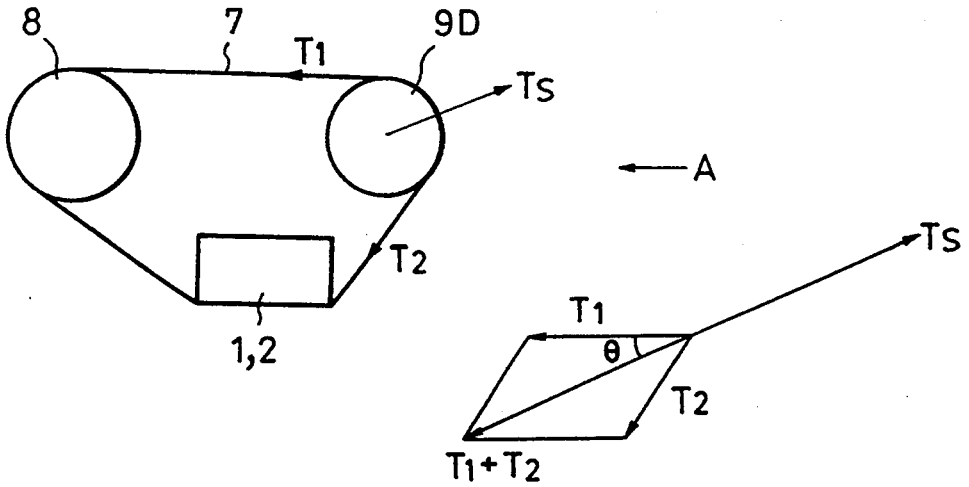
FIG. 11*a* shows forces applied to the fusing film in the fusing film drive of FIG. 10.

In this embodiment, a tension guide 9D has a cylindrical shape. The tension guide 9D is, as shown in FIG. 11, made up of a rotatable roller **9*e* in the center, and stationary (non rotatable) cylinders 9*f* at the ends. Axes 9*g* are projecting from the end surfaces of the rotatable roller 9*e* in the center of the tension guide 9D. The axes 9*g* are fitted into the holes bored in the stationary cylinders 9*f* at the ends of the tension guide 9D. This structure allows only the :rotatable roller 9*e*** in the center to rotate.

Figure 11B:
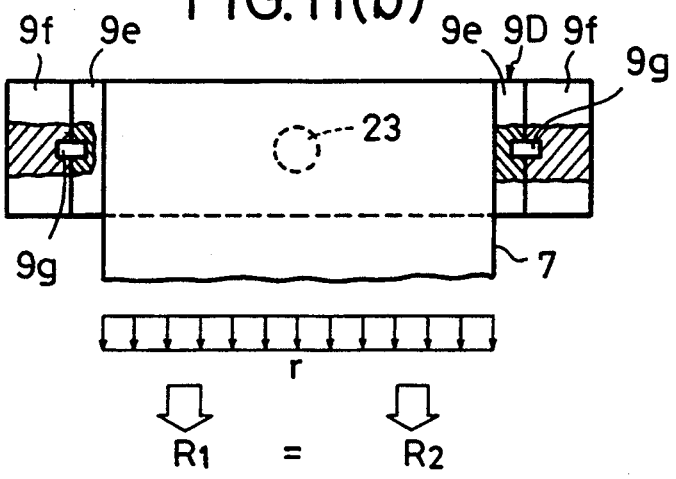
FIGS. 11*b* and 11*c* show the position of the fusing film on a tension guide and the load to the tension guide.
Figure 11C:
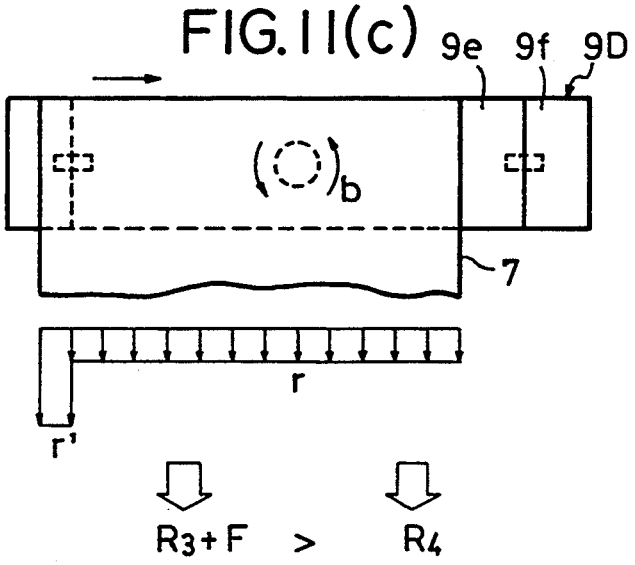
Figure 12A:
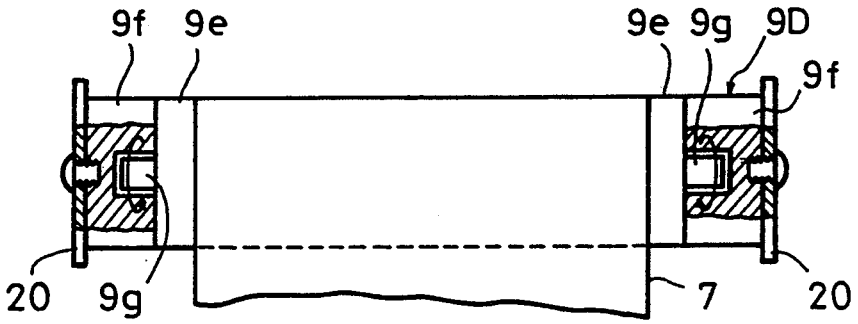
FIGS. 12(*a*) to 12(*c*) are diagrams for explaining the shift in the position of fusing film on the tension guide and the self-aligning capability of the fusing film.
Figure 12B:
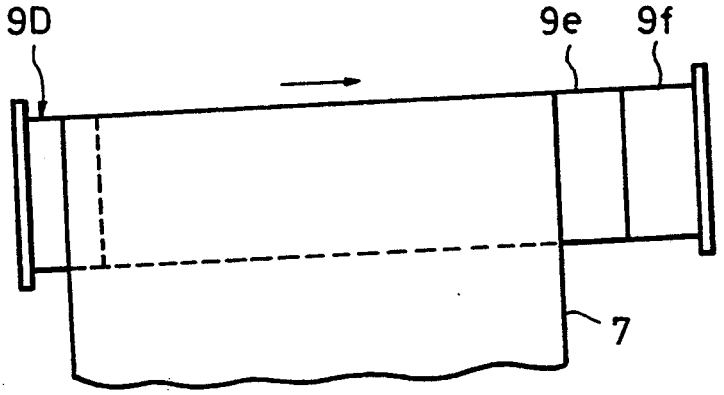
Figure 12C:
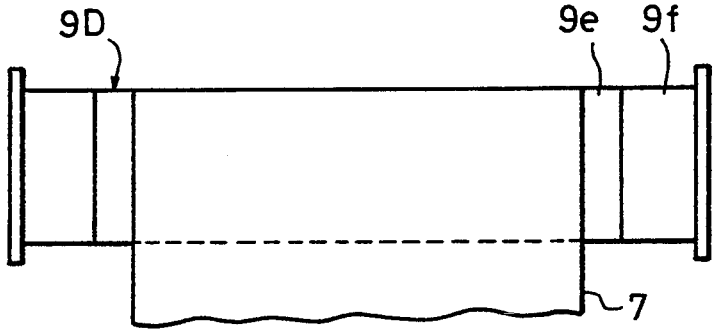
Figure 13:
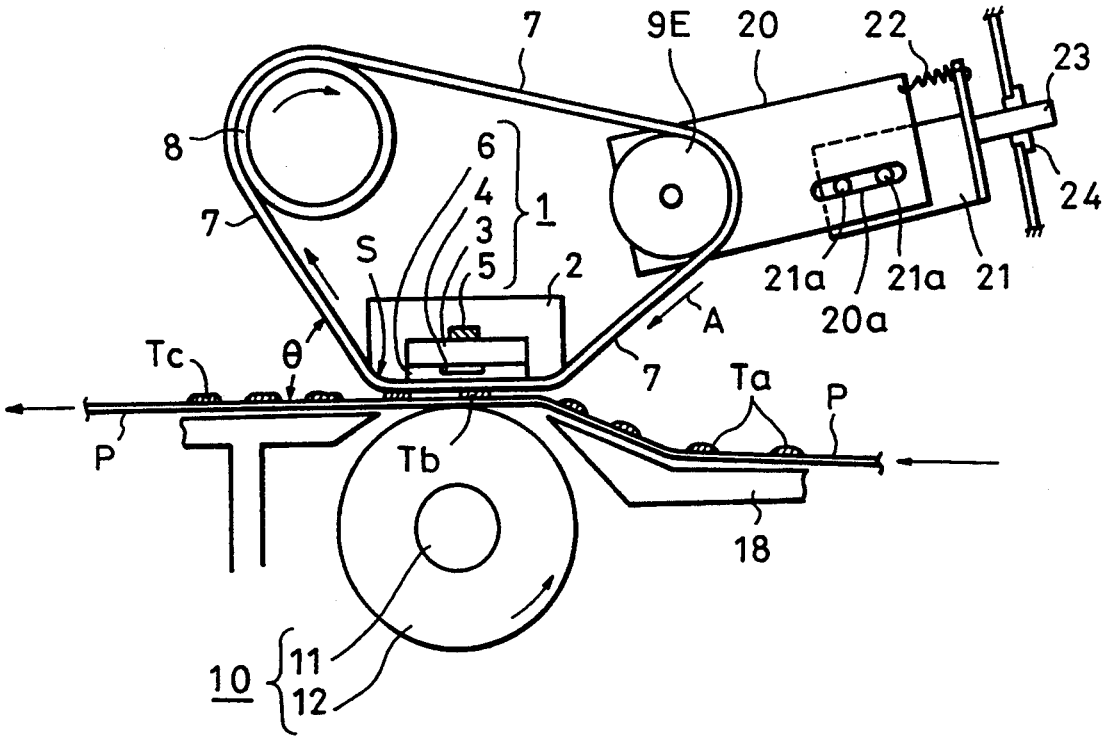
FIG. 13 is a schematic side view of a fusing mechanism in a fifth embodiment of the present invention.

In a fusing mechanism having the foregoing tension guide 9D, when the fusing film 7 runs while being placed on the tension guide 9D symmetrically with the axis rod 23 as a center as shown in FIG. **11*b*, the longitudinal load distribution on the guide 9D is symmetrical with respect to the axis rod 23 as a center as shown in FIG. 11*b*. The total load on the left of the axis rod 23, $R_1$, equals the total load on the right thereof, $R_2$. This means that an angular moment does not occur in the seesaw 21 and tension guide 9D. When the fusing film 7 runs while deviating leftward from the axis 23 as shown in FIG. 11*c*, the left margin of the fusing film 7 rides on the stationary cylinder 9*f* at the left end of the tension guide 9D. The load distributed to the left end, r', becomes larger than the load distributed to the roller 9*e*, *r*. Accordingly, the total load on the left of the axis rod 23, $R_3+F$, becomes larger than the total load on the right thereof, Ry. This brings about a moment of force applied to the seesaw 21 and tension guide 9D clockwise about the axis rod 23. As a result, as shown in FIG. 12*b*, the seesaw 2 and tension guide 9D turn leftward with the axis rod 23 as a center, and thus tilt. The fusing film 7 is then twisted. A force directed toward the ascending end of the tension guide 9D occurs, as described previously, in the fusing film 7. The fusing film 7 then returns to the original position shown in FIG. 12*a* over the tension guide 9D. When the Fusing film 7 returns to the original position as shown in FIG. 12*c*, the seesaw 21 and tension guide 9D are leveled, and the force of movement in the cross direction of the fusing film 7** dies out.

In this embodiment, the ends of the tension guide 9D are provided as the stationary cylinders **9*f*. Therefore, when the fusing film 7 rides on one of the stationary cylinders 9*f*, the distributed load r' becomes larger than the distributed load of the rotatable roller 9*e* in the center of the tension guide 9D. This means that a quite asymmetrical load distribution is attained with respect to the axis rod 23. As a result, the fact that the fusing film 7 has deviated laterally on the tension guide 9D is detected with a higher sensitivity, and a larger force is exerted to return the fusing film 7** to the original position.

FIGS. 13 to 16 show a fusing mechanism in the fifth embodiment of the present invention. Components in this embodiment identical to those described in the first to fourth embodiments will not be described.

A tension guide 9E in this embodiment has a structure based on a roller similar to the tension guide 9D described in the fourth embodiment.

Figure 15:
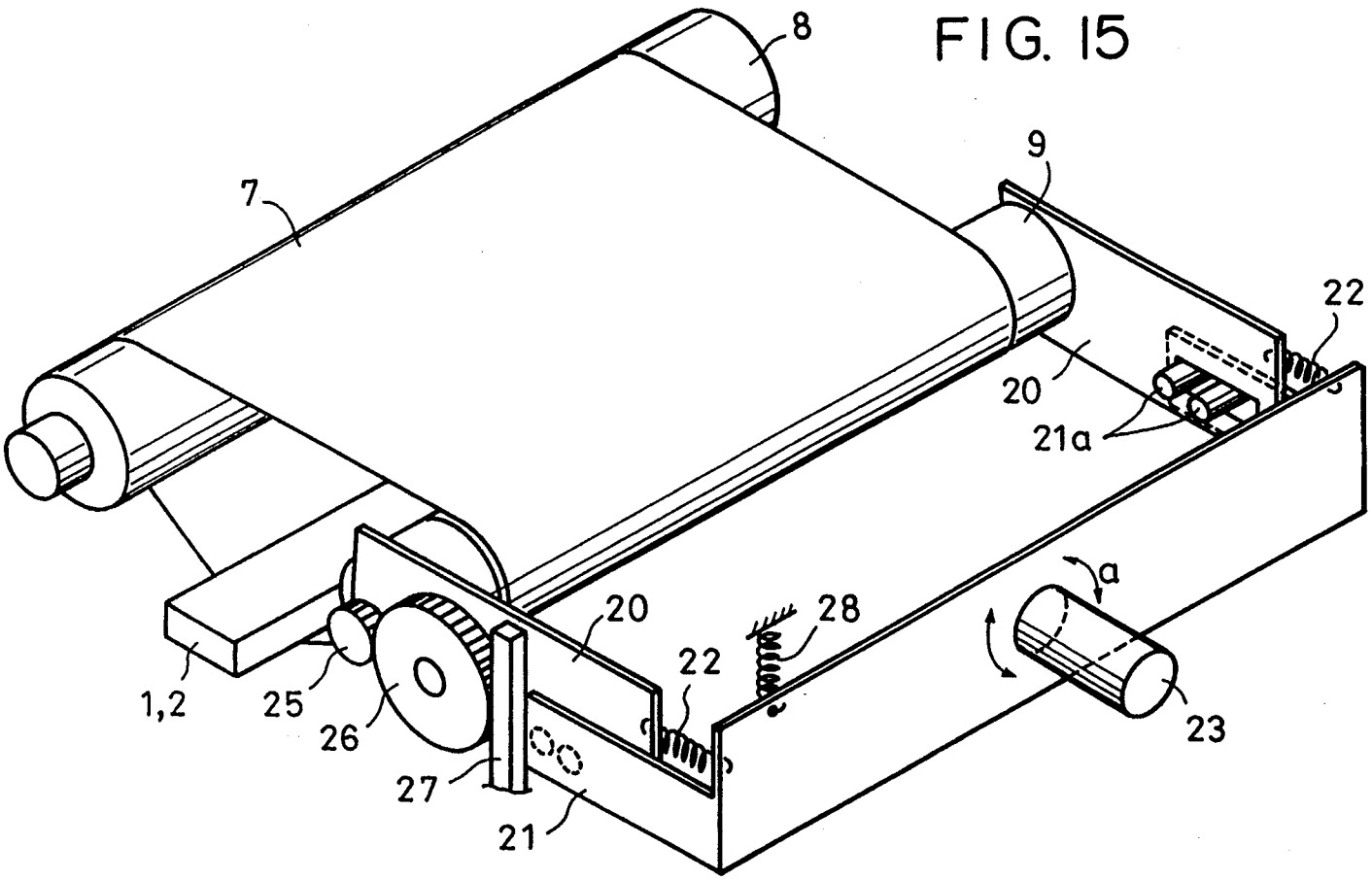
FIG. 15 is a perspective view showing an appearance of a fusing film drive in the fusing mechanism of FIG. 13.
Figure 16:
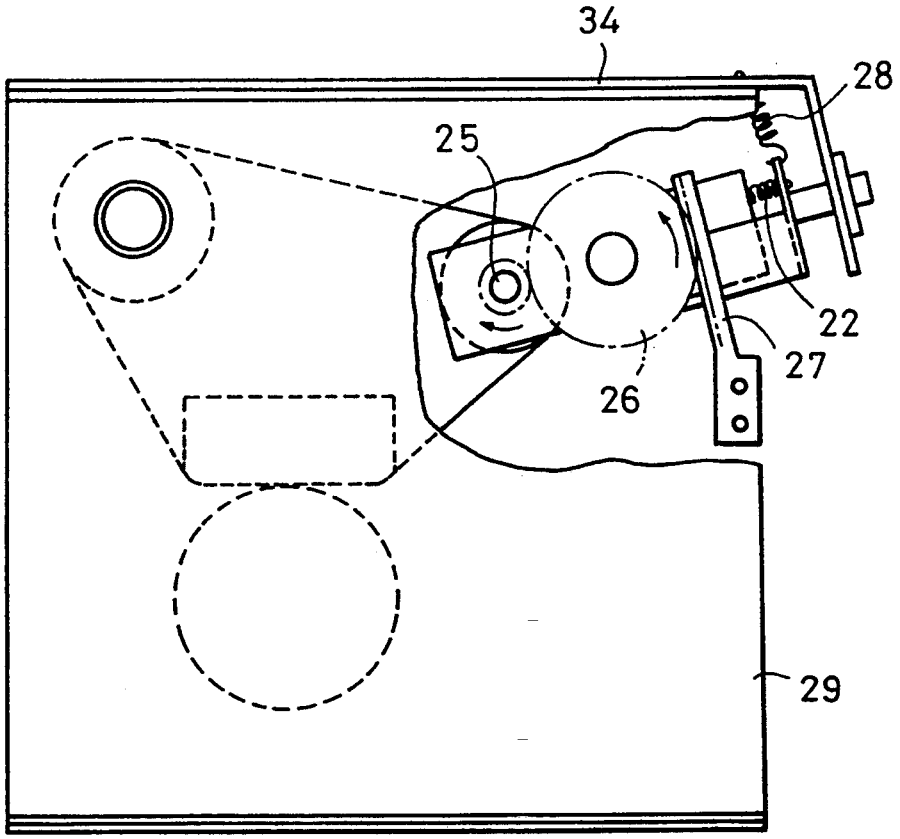
FIG. 16 is a partly broken-out side view of the fusing film drive.

In the roller type tension guide 9E employed in this embodiment, as shown in FIG. **14*a*, the left-end short part of the tension guide 9E is formed as a rotatable roller 9*h*, and the other part thereof is formed as a non-rotatable cylinder 9*i* fixed to the sliding plate 20. An axis rod 9*j* is projecting from the left-end surface of the rotatable roller 9*h*. The axis rod 9*j* is held in an axis hole penetrating through the sliding plate 20 so as to be rotatable, projecting outside the sliding plate 20, and engages with a gear 25. The gear 25, as shown in FIGS. 15 and 16, engages with a gear 26 that is mounted on the sliding plate 20 so as to be rotatable. The gear 26 engages with a rack 27. The rack 27 Is fixed to a stationary structure 29**.

A spring 28 is, as shown in FIG. 16, laid between the seesaw 21 and stationary structure 34. With the spring 28, the seesaw 21 is biased or pressed so as to tilt down the left end of the tension guide 9E, thus rotating the tension guide.

Figure 14A:
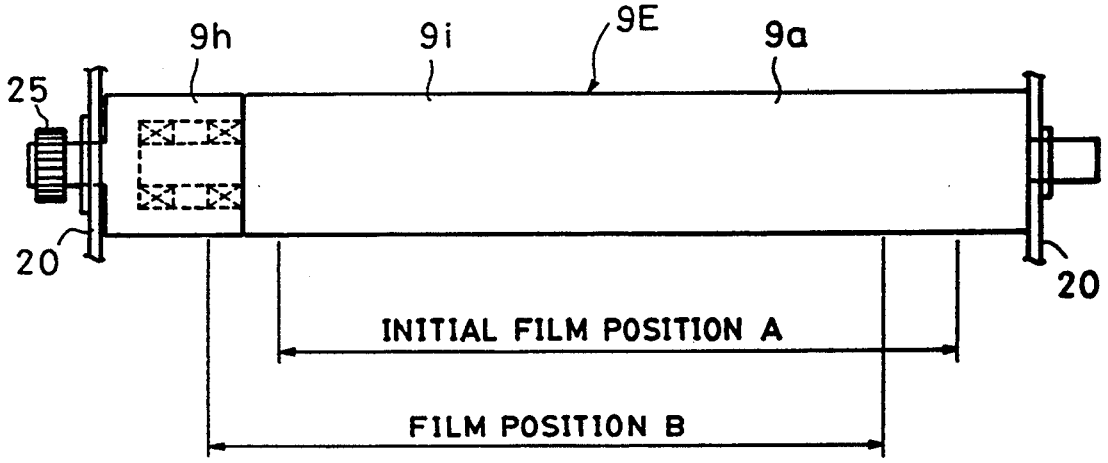
FIG. 14*a* shows an appearance of a tension guide in the fusing mechanism of FIG. 13.

The non-rotatable cylinder **9*i* occupies a large portion of the tension guide 9E. An axis rod 9*k* is projecting from the left-end surface thereof as shown in FIG. 14*a*. The axis rod 9*k* is born by a bearing 9*m* mounted in an axis hole of the rotatable roller 9*h*. Specifically, the rotatable roller 9*h* is supported so as to be rotatable owing to the axis rod 9*k* of the non-rotatable cylinder 9*i* and the axis hole bored on the sliding plate 20. The right end of the non-rotatable cylinder 9*i* is fixed to the sliding plate 20, and the left end thereof is supported by the rotatable roller 9*h***.

Figure 14B:
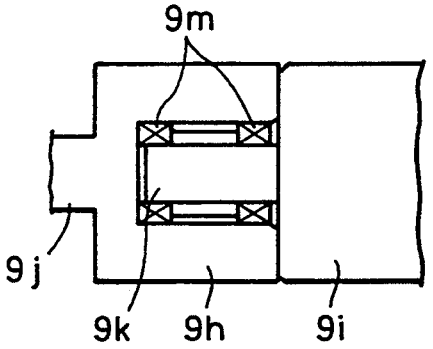
FIG. 14*b* shows an enlarged longitudinal cross section of part of the tension guide.

The axial length of the non-rotatable cylinder **9*i* exceeds the width of the fusing film 7 (indicated as "initial film position" in FIG. 14). In a running state in which the fusing film 7 does not cause a deviation, the fusing film 7 is in contact with the non-rotatable cylinder 9*i* alone in the range indicated as film position A in FIG. 14*a***.

When the fusing film 7 is running in contact with the non-rotatable cylinder **9*i* at the position A in FIG. 14, since the left end of the tension guide 9E is pressed to tilt by means of the spring 28, the fusing film 7 moves gradually leftward and reaches the film position B in FIG. 14*a*. Consequently, the fusing film 7 rides on the rotatable roller 9*h*. The roller 9*h* is then rotated in the direction in which the fusing film 7 runs. This causes the gear 25 to rotate clockwise as shown in FIG. 16. The gear 26 is then rotated counterclockwise. Since the rack 27 engaging with the gear 26 is fixed, the gear 26 rolls down over the rack 27. A descending force is then applied to the sliding plate 20 united with the gear 26 and the left end of the seesaw 21. As a result, the seesaw 21 turns counterclockwise with the axis rod 23 as a center in FIG. 15. The left end of the tension guide 9E further tilts to twist the fusing film 7. Based on the aforesaid principle, a force attempting to move toward the right end of the tension guide 9E occurs in the fusing film 7. As a result, the fusing film 7 returns to the "initial film position" in FIG. 14*a*. When the fusing film 7 has moved from the rotatable roller 9*h* to the non-rotatable cylinder 9*i*, the force the gear 26 has applied to the seesaw 21 disappears, and the force having caused the tension guide 9E** to tilt leftward also disappears.

In the aforesaid embodiments, an endless belt drive is implemented in an image heating apparatus. Needless to say, the endless belt drive can apply to other arrangements.

Particular embodiments of the present invention have been described so far. However, the present invention is not confined to these embodiments but can be modified in various forms within the scope of the following claims.

What is claimed is:

1. An endless belt driving device, comprising:

an endless belt;

a driving means for driving said endless belt;

a guide member for guiding movement of said endless belt; and a supporting means for rotatably supporting said guide member so that said guide member is rotatable about an axis extending in a direction perpendicular to a lateral dimension of said guide member in response to lateral displacement of said belt, wherein said guide member has two end sections and a center portion, the center portion having a smaller friction factor than said end sections.

2. An endless belt driving device according to claim 1, wherein when said endless belt is laterally displaced, a load resulting from the lateral displacement causes said guide member to rotate, whereupon a force oriented opposite to the lateral displacement acts on said endless belt to counteract said lateral displacement.

3. An endless belt driving device according to claim 1, wherein a distance between said end sections exceeds a width of said endless belt.

4. An endless belt driving device according to claim 1, wherein said supporting means has a U-shaped member for supporting said guide member at ends thereof.

5. An endless belt driving device according to claim 4, wherein said U-shaped member has a rotation axis rod, in the center thereof, which is supported by a bearing.

6. An endless belt driving device according to claim 1, wherein said guide member has a circular cross-section, said cross-section having a larger diameter at ends of said guide member than at a center portion of said guide member.

7. An image heating apparatus, comprising:

an endless belt;

a driving means for driving said endless belt;

a guide member for guiding movement of said endless belt;

a heater for heating an image on a recording material through said endless belt; and a supporting means for rotatably supporting said guide member so that said guide member is rotatable about an axis extending through a mid-point of said guide member in a direction perpendicular to a lateral dimension of said guide member, wherein said guide member has two end sections and a center portion, the center portion having a smaller friction factor than said end sections.

8. An image heating apparatus according to claim 7, further comprising a pressurizing member that cooperates with said heater to form a nip through which said endless belt passes.

9. An image heating apparatus according to claim 7, wherein when said endless belt is laterally displaced, a load resulting from the lateral displacement causes said guide member to rotate, whereupon a force oriented opposite to said lateral displacement acts on said endless belt to counteract said lateral displacement.

10. An image heating apparatus according to claim 7, wherein a distance between said end sections exceeds a width of said endless belt.

11. An image heating apparatus according to claim 7, wherein said supporting means has a U-shaped member for supporting said guide member at ends thereof.

12. An image heating apparatus according to claim 11, wherein said U-shaped member has a rotation axis rod in center thereof which is supported by a bearing.

13. An image heating apparatus according to claim 7, wherein said guide member has a circular cross-section, said cross-section having a larger diameter at ends of said guide member than at a center portion of said guide member.

14. An endless belt driving device, comprising:

an endless belt;

a driving means for driving said endless belt;

a guide member for guiding movement of said endless belt; and a supporting means for rotatably supporting said guide member so that said guide member is rotatable about an axis extending in a direction perpendicular to a lateral dimension of said guide member in response to lateral displacement of said belt, wherein said guide member is a roller, said roller including a center portion and two end sections, said center portion being rotatable about a longitudinal axis of said roller, and said end sections being fixed with respect to rotation about said longitudinal axis.

15. An image heating apparatus, comprising:

an endless belt;

a driving means for driving said endless belt;

a guide member for guiding movement of said endless belt;

a heater for heating an image on a recording material through said endless belt; and a supporting means for rotatably supporting said guide member so that said guide member is rotatable about an axis extending through a mid-point of said guide member in a direction perpendicular to a lateral dimension of said guide member, wherein said guide member is a roller, said roller including a center portion and two end sections, said roller portion being rotatable about a longitudinal axis of said roller, and said end sections being fixed with respect to rotation about said longitudinal axis.

16. An endless belt driving device, comprising:

an endless belt;

a driving means for driving said endless belt;

a guide member for guiding movement of said endless belt, said guide member including a roller portion, which is rotatable about a longitudinal axis of said guide member, and a portion which is not rotatable about said longitudinal axis, said portions being disposed along a length of said guide member; and a supporting means for rotatably supporting said guide member, said supporting means including:

bias means for biasing said guide member so as to apply a force to said guide member which tends to produce rotation of said guide member about an axis extending in a first direction perpendicular to said length of said guide member, and means for producing rotation of said guide member in a second direction, opposite to said first direction, in response to contact between said endless belt and said rotatable roller portion of said guide member.

17. An endless belt driving device according to claim 16, further comprising a heater and a pressurizing member that cooperates with said heater to form a nip through which said endless belt passes.

* * * * *

UNITED STATES PATENT AND TRADEMARK OFFICE

CERTIFICATE OF CORRECTION

PATENT NO. : 5,365,321
DATED : November 15, 1994
INVENTOR(S) : MASATO KOSHIMIZU, ET AL.

It is certified that error appears in the above-indentified patent and that said Letters Patent is hereby corrected as shown below: On the title page: Item [30] Priority Data Column [30],
line FAPD, "Jun. 5, 1992 [JP] Japan...145871" should read --Jun. 5, 1992 [JP] Japan...4-145871--.

Column 2,
line 19, "detects" should read --detect--.

Column 3,
line 12, "be;It," should read --belt--.

Column 6,
line 47, "toiler" should read --roller--.

Column 8,
line 43, "turns" should read --turn--.

Column 9,
line 11, ":rotatable" should read --rotatable--.

Column 10,
line 17, "born" should read --borne--.

Signed and Sealed this

Fourth Day of April, 1995

Bruce Lehman

*Attest:*

BRUCE LEHMAN

*Attesting Officer*

*Commissioner of Patents and Trademarks*